United States Patent [19]

Boliver

[11] 4,340,790

[45] Jul. 20, 1982

[54] ELECTRICAL SWITCH WITH MELAMINE LOADED THERMOPLASTIC ABLATIVE MATERIAL

[75] Inventor: Vincent J. Boliver, Pittsfield, Mass.

[73] Assignee: General Electric Company, Philadelphia, Pa.

[21] Appl. No.: 932,060

[22] Filed: Aug. 8, 1978

Related U.S. Application Data

[63] Continuation of Ser. No. 716,130, Aug. 20, 1976.

[51] Int. Cl.[3] ..... H01H 33/70; H01H 9/30

[52] U.S. Cl. ..... 200/144 C; 200/149 A; 174/152R

[58] Field of Search ..... 200/144 C, 149 A; 174/152; 334/111

[56] References Cited

U.S. PATENT DOCUMENTS

| | | | |
|---|---|---|---|
| 2,768,264 | 10/1956 | Jones et al. | 200/144 C |
| 3,513,437 | 5/1970 | McMorris | 200/144 C |
| 3,542,986 | 11/1970 | Kotski | 200/149 A |
| 3,551,587 | 12/1970 | Propst | 174/152 |
| 3,582,586 | 6/1971 | Jones | 200/144 C |
| 3,587,035 | 6/1971 | Kotski | 339/111 |
| 3,632,926 | 1/1972 | Heft | 200/144 C |
| 3,761,660 | 9/1973 | Jones | 200/144 C |
| 3,930,709 | 1/1976 | Stanger et al. | 200/144 C |

*Primary Examiner*—Robert S. Macon

*Attorney, Agent, or Firm*—William Freedman; Carl L. Silverman

[57] ABSTRACT

A separable connector module for live switching of shielded electrical power cable comprises a rod contact and a rod-shaped follower molded about a reinforcing pin fixed to one end of the rod contact. The follower is of thermoplastic ablative material consisting essentially of acetal resin loaded with melamine; the melamine constituting between one-fourth to about one-half the ablative material by weight.

3 Claims, 2 Drawing Figures

ELECTRICAL SWITCH WITH MELAMINE LOADED THERMOPLASTIC ABLATIVE MATERIAL

This is a continuation of application Ser. No. 716,130, filed Aug. 20, 1976.

BACKGROUND OF THE INVENTION

The present invention relates generally to electrical power switches, and particularly to separable connector switch modules for shielded electrical power distribution cables which include ablative material for load-break operation.

Separable connector assemblies for underground power distribution cable, or shielded cable, are water-tight when assembled and may be readily separated into two or more units to break a cable connection. As such units are available separately commercially and are individually subject to special design considerations, they are commonly referred to as "modules". Thus, a connector assembly includes two or more matching modules assembled together.

One type of separable connector assembly commonly used is a "rod and bore" switching type. A switch module having a receiving bore tube, or snuffer, situated within a passageway in a shielded, insulating housing and a grasping contact member at the interior end of the bore tube receives a matching rod connector module having a rod contact which is inserted in the bore and grasped by the bore contact member. Examples of this type of connector assembly are described, for example, in the following U.S. Pat. Nos.:

3,513,437 issued May 19, 1970 to W. A. Morris
3,542,986 issued Nov. 24, 1970 to E. J. Kotski
3,551,587 issued Dec. 29, 1970 to R. F. Propst, and
3,587,035 issued June 22, 1970 to E. J. Kotski It is desirable to be able to operate such connectors and interrupt the power while the cables are energized. As the cables are generally carrying power at a voltage on the order of thousands of volts, separation of the contacts of the connector on an energized cable results in the formation of an electric arc between the contacts. The arc will, unless promptly extinguished, eventually strike a ground plane such as the grounded shielding of the modules, and create a direct line-to-ground fault.

In present connectors, the bore of a snuffer tube is lined with ablative material, a material which generates arc-extinguishing gases when subjected to an electric arc. An arc follower, a rod-shaped extension at the end of the metal contact rod is also of ablative material. When the contact rod is pulled from the grasping contacts of the bore module, the resulting arcing passes between the follower and the snuffer liner. The exposure of the ablative material to the arcing causes it to generate arc-extinguishing gases which rapidly extinguish the arc. This permits the connector to be utilized as a switch by being operated under live conditions, without creating a line-to-ground fault.

There is a problem in finding a suitable ablative material for the follower. The material must be sufficiently effective in generating arc-quenching gases while also being strong enough mechanically to withstand a relatively high bending moment which might be inadvertently applied by an operator in joining or separating a matching pair of modules.

It has been found, for instance, that in general the ablative materials most effective for generating arc-quenching gases, such as melamine for example, do not have the necessary mechanical strength and are likely to fracture on operation where the cables to the connector modules are improperly trained.

Various materials with high mechanical strength and which can be loaded with an ablative material such as melamine are not as effective in generating gases of the proper dielectric strength and may have other disadvantages either in the electrical characteristics or in the manufacturing process.

Nylon has a tendency to absorb moisture and to track along the surface under high-voltage conditions until a conductive path is formed. This can lead to an electrical failure. It also requires a relatively high degree of loading with ablative material.

Acrylic resins have less desirable mechanical characteristics than does nylon and is more difficult to mold in the manufacturing process.

Epoxy resins do not have sufficient mechanical strength when loaded with melamine and involve costly production procedures.

SUMMARY OF THE INVENTION

The novel switching device comprises a rod contact and a rod-shaped follower molded about a reinforcing pin fixed to one end of the rod contact. The follower is of an ablative material composition which consists essentially of an acetal resin loaded with finely divided melamine, the melamine constituting from about one-fourth to about one-half of the composition by weight.

The ablative material is uniquely suited for the present device in being sufficiently strong mechanically, being relatively unaffected by moisture, and being highly effective in generating arc-quenching gases of the proper dielectric strength, while nevertheless readily lending itself to injection molding in production.

DESCRIPTION OF THE PREFERRED EMBODIMENT

Figure 1:
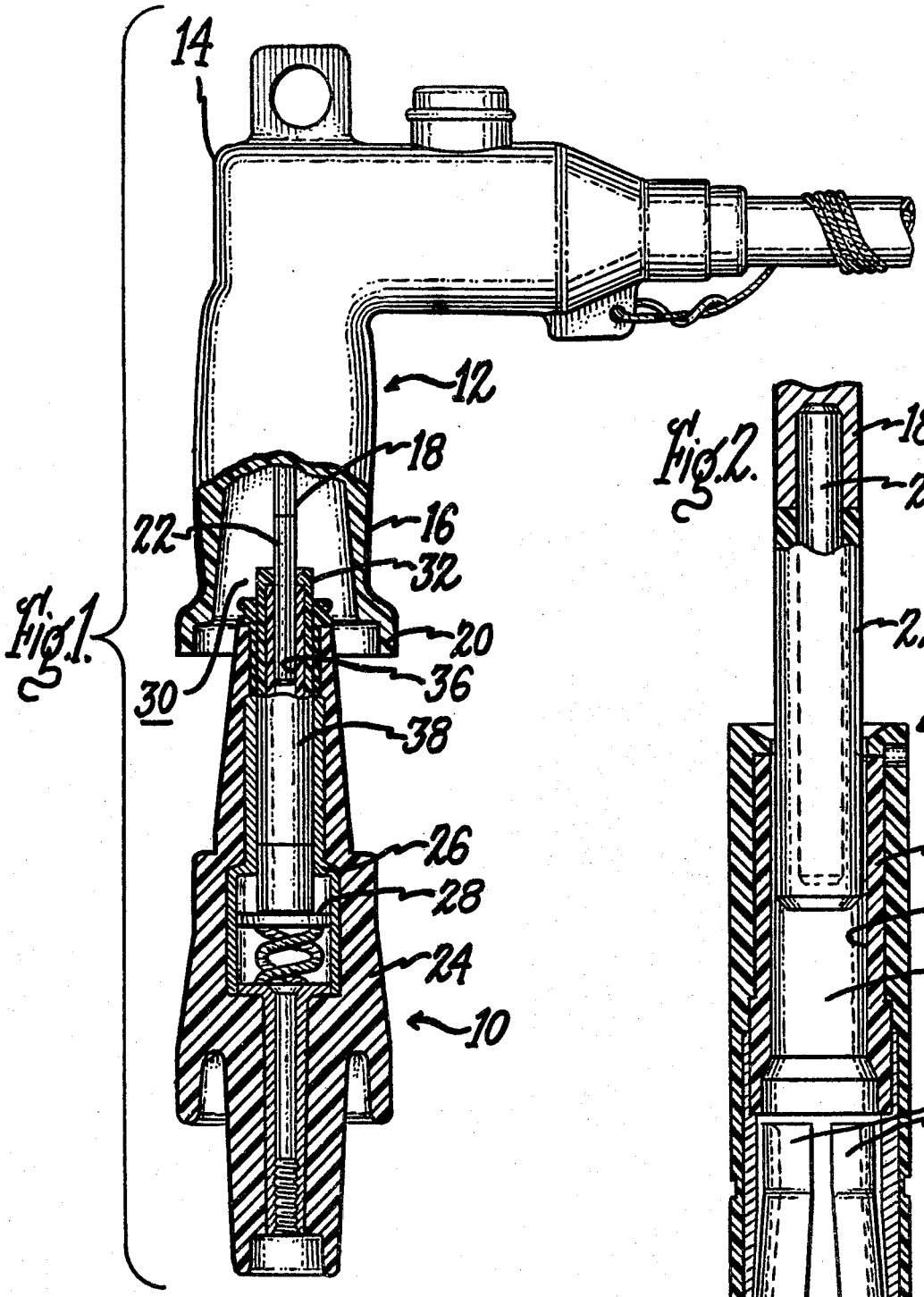
FIG. 1 is a partially sectioned side view of a separable connector assembly partially assembled, the assembly including a rod connector module and a bore connector module in accordance with the preferred embodiment.

A preferred embodiment of the invention is the separable connector switch module 10 of the bore type shown in FIG. 1 together with a matching rod connector module 12 to illustrate the manner of their interconnection.

The rod module 12 has an elastomeric housing 14 provided on its outside surface with a conductive shield layer 16, which is grounded. A metal contact rod 18 extends from within the housing 12 into a cup-shaped gas shield 20 of the housing 14. At the end of the metal contact rod 18, shown in more detail in FIG. 2, extends a rod follower 22 of ablative material of acetal copolymer resin loaded with finely divided melamine to one-fourth the weight of the material. The ablative material is injection molded on an epoxy bonded glass fiber reinforcing pin 23. The pin 23 is fixed at one end into a hole in the contact rod 18. The metal contact rod 18 itself is connected to the conductor of the power cable inside the housing 14 by threading into a metal rod support member inside the housing 14.

The switch module 10 is designed to be mated with the rod module 12 on one end and to be rigidly mounted at the other end into a bushing well such as, for instance might be in a transformer housing or switch housing wall. The bore switch module 10 comprises an insulating housing 24 of EPDM (ethylene-propylene-dienemonomer) rubber in which there is embedded a metal sleeve 26 having receiving threads for a mounting stud at one end to hold the module 10 in place in the bushing well, and having at its other end a metal sleeve 26 defining an elongated rod-receiving passageway. That portion of the switch module housing 24 surrounding the sleeve 26 is a truncated cone which closely matches the configuration of the inside of the gas shield 20 of the rod module housing 14 to form a watertight electrically insulating seal when the two modules 10, 12 are joined.

At the end of the interior end of the sleeve 26 inside the switch module housing 24 is a gas-actuated piston 28. Rigidly attached to the piston 28 by means of a thread engagement is a snuffer assembly 30.

Figure 2:
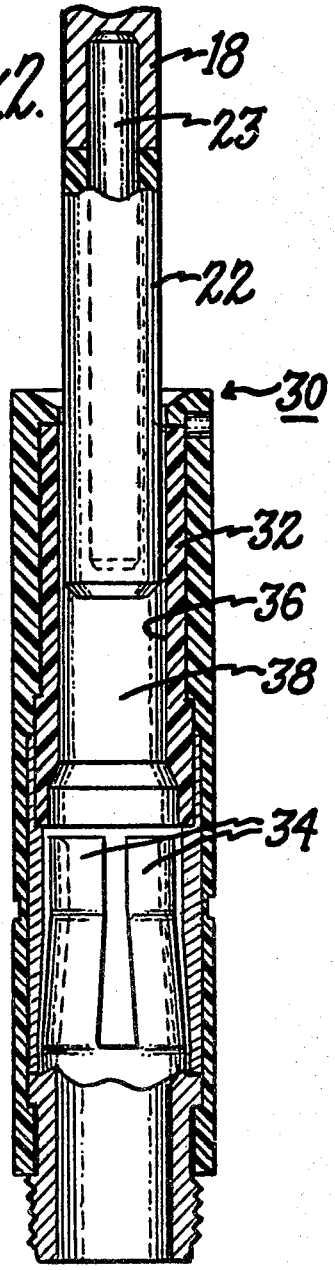
FIG. 2 is a side sectional view of a snuffer assembly of the bore module of the FIG. 1 with a rod of the rod module of FIG. 1 partially inserted in the bore.

The snuffer assembly 30, shown in greater detail in FIG. 2, with the follower 22 just entering its bore, includes an insulating thermoplastic snuffer tube 32 having attached to it at the innermost end a set of resilient-fingered metal rod-receiving contacts 34. The inside wall of the snuffer tube 32 is provided with an ablative snuffer liner 36 of an acetal copolymer resin loaded with finely divided melamine to one-half the weight of the material. The inside surface of the liner 36 defines the bore 38.

The follower 22 has less melamine loading to provide maximum mechanical strength. As strength is not as critical for the snuffer liner 36, the melamine loading for the acetal resin of the liner 36 is increased to one-half there. The degree of loading is not highly critical, but a one-half loading has been found to be too weak for use on the follower 22, while a one-fourth loading for the liner 36 does not result in sufficient generation of arc-quenching gases.

The follower 22 has an additional advantage of contributing to the ease of operation of the modules 10, 12 because the acetal resin has a relatively high surface lubricity in sliding contact with the liner 36 and the contacts 34.

While the acetal resin of the modules 10, 12 of the preferred embodiment was an acetal copolymer, such as the product designated by the trademark "Celcon" M90-04 and manufactured by the American Celanese Corp., an acetal monomer such as the product designated by the trademark "Delrin" and manufactured by the DuPont DeNemours Co. is also suitable for use in a similar fashion.

The present invention includes switching devices other than separable connector modules as in the preferred embodiment. Switches with ablative material can be used for circuit breakers and cutouts, for example. In general, the invention includes any switching device comprising thermoplastic material provided specifically for generating arc-quenching gases upon exposure of its surface to arcing.

I claim:

1. A separable electrical connector assembly including mating switch and connector modules respectively having mating bore and rod contact members, each of the modules including an insulating housing with portions thereof having closely matched configurations so as to form a substantially insulating seal when the modules are mated together, the rod contact member having a rod-shaped arc follower of thermoplastic ablative composition material located at a contact engaging end thereof, means for securing said rod-shaped arc follower to said rod contact comprising a reinforcing pin about which said arc follower is molded, the reinforcing pin extending from said rod contact to a location near the free end of said arc follower, said arc follower being subject to a relatively high bending moment when said modules are being mated together or being separated from each other, said arc follower being sufficiently strong enough mechanically to withstand said bending moment, wherein said ablative composition material consists essentially of acetal resin loaded with finely divided melamine in an amount between one fourth and substantially less than one-half of said composition by weight, said switch module including a snuffer tube adjacent said bore contact member, said snuffer tube including an ablative snuffer liner of the same material as said arc follower but having a relatively higher loading of melamine.

2. A separable electrical connector assembly in accordance with claim 1 in which said ablative material has a relatively high surface lubricity.

3. The connector assembly of claim 1 in which the material of said snuffer liner is loaded with about one-half melamine.

* * * * *